US007152556B2

(12) United States Patent
Goltsman

(10) Patent No.: US 7,152,556 B2
(45) Date of Patent: Dec. 26, 2006

(54) LINEAR TO ROTATIONAL MOTION CONVERTER

(76) Inventor: Mark M. Goltsman, 53 Westerlde Ave., Rochester, NY (US) 14620

( * ) Notice: Subject to any disclaimer, the term of this patent is extended or adjusted under 35 U.S.C. 154(b) by 0 days.

(21) Appl. No.: 11/272,955

(22) Filed: Nov. 15, 2005

(65) Prior Publication Data

US 2006/0107918 A1 May 25, 2006

Related U.S. Application Data

(60) Provisional application No. 60/629,920, filed on Nov. 22, 2004.

(51) Int. Cl.
*F02B 75/18* (2006.01)
*F02B 75/32* (2006.01)

(52) U.S. Cl. ..... 123/52.4; 123/197.4; 74/44

(58) Field of Classification Search ..... 123/197.4, 123/52.4, 52.6, 53.2; 74/40, 44
See application file for complete search history.

(56) References Cited

U.S. PATENT DOCUMENTS 3,537,437 A * 11/1970 Ana et al. ..... 123/52.4
4,598,672 A * 7/1986 Jayne et al. ..... 123/197.4

* cited by examiner

*Primary Examiner*—Noah P. Kamen

(57) ABSTRACT

A mechanism or "motion converter" including cylinder, piston, yoke, 2 crankshafts and 2 gears converts linear motion of piston to rotary motion (or reverse) of crankshafts without creating the lateral force applied to the piston. Kinematics characteristics of the motion converter reduce the speed of the piston on the way down and enhance the efficiency of the combustion process in the case of using it in the combustion engine.

5 Claims, 4 Drawing Sheets

| Rotating angle of crankshaft | Existing Mech. | Straight Yoke | | Shaped Yoke | |
|---|---|---|---|---|---|
| | Stroke | Stroke | Ratio coefficient "k" | Stroke | Ratio coefficient "k" |
| 0° | .000 | .000 | | .000 | |
| 30° | .092 | .067 | .73 | .035 | .38 |
| 60° | .327 | .25 | .76 | .151 | .46 |
| 90° | .604 | .500 | .83 | .366 | .60 |
| 120° | .827 | .750 | .91 | .651 | .79 |
| 150° | .958 | .933 | .97 | .901 | .94 |
| 180° | 1.000 | 1.000 | | 1.000 | |

Stroke values

| Rotating angle of crankshaft | Existing Mechanism | | | Straight Yoke | | | Shaped Yoke | | |
|---|---|---|---|---|---|---|---|---|---|
| | Force $F_1$ | Active Force | Torque Force | Force, Active Force $F_2$ | Torque Force | Torque Increase % % | Force, Active Force $F_2$ | Torque Force | Torque Increase % % |
| 30° | 1.00 | 1.02 | 0.68 | 1.37 | 0.68 | 0.00 | 2.63 | 1.31 | 92 |
| 60° | 1.00 | 1.07 | 1.05 | 1.31 | 1.13 | 8 | 2.17 | 1.88 | 79 |
| 90° | 1.00 | 1.09 | 1.00 | 1.20 | 1.20 | 20 | 1.64 | 1.64 | 50 |
| 120° | 1.00 | 1.07 | 0.68 | 1.10 | 0.95 | 40 | 1.27 | 1.10 | 62 |

Active forces and Torque values

LINEAR TO ROTATIONAL MOTION CONVERTER

This application claims priority to Provisional Patent Application No. 60/629,920, filed on Nov. 22, 2004.

REFERENCE CITED

U.S. Pat. No. 5,331,926, Jul. 26, 1994, inventors: Melvin A. Vaux, Thomas R. Denner.

BACKGROUND

The most common and widely used mechanism for converting linear motion to rotational motion, includes a piston moving in a cylinder and rotating the crank shaft by means of a connecting rod. This mechanism has a drawback: through all of its movement the piston is subject to a lateral force pressing it against the cylinder's wall. This increases frictional resistance to the active force.

Another type of mechanism is used in the "Dwelling Scotch Yoke Engine", U.S. Pat. No. 5,331,926, Jul. 26, 1994. This engine uses a mechanism for converting linear motion of the piston in to rotational motion of the flywheel using the piston and rod with scotch yoke as one solid part. This changes the kinematics and action of the forces but still creates the force, which acts off of the piston axis. The bushing in the cylinder block is used to guide the rod and prevents the piston from experiencing of this force.

SUMMARY OF THE INVENTION

In summary, this invention is a mechanism to convert reciprocating motion to rotational motion and rotational motion to reciprocating motion. The mechanism includes a cylinder block with a cylinder bore. A piston-yoke disposed for reciprocating motion relative to the cylinder block includes a transverse yoke slot, and a piston extending perpendicularly from the slot into the cylinder bore. Opposing parallel crankshafts are operatively connected to the piston-yoke, each crankshafts including a crankpin extending through the yoke slot for reciprocating motion along the slot as the piston reciprocates and the crankpin revolves in an orbital path relative to its crankshaft. Crankshafts further include a crankpin bearing around each crankpin, the bearings being non-rotatable and slidable within the yoke slot. Each crankshaft includes a drive gear fixed to it, the drive gears being in mutual engagement for synchronous opposing rotation of crankshafts.

BRIEF DESCRIPTION OF THE DRAWINGS

The accompanying drawings illustrate the invention.

In such drawings.

Only half the portion of the cylinder block is shown in all views for clarity.

DESCRIPTION OF THE PREFERRED EMBODIMENT

Figure 3:
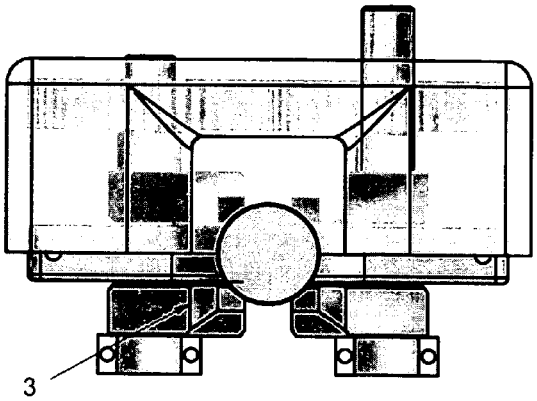
FIGS. 1, 2 and 3 are the front, side and top views of motional converter with straight yoke.
Figure 4:
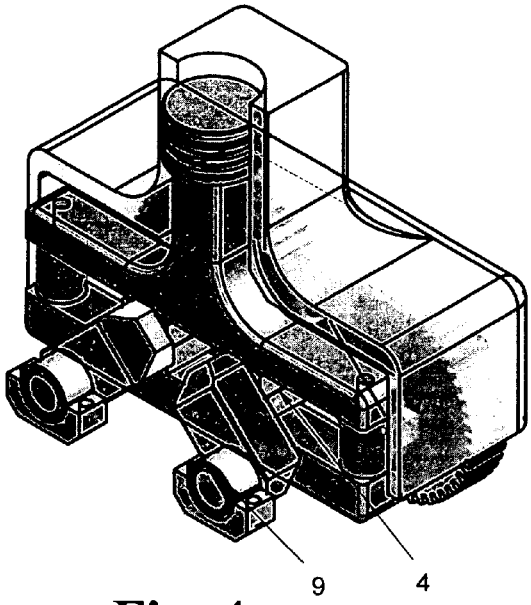
FIG. 4 is the isometric view of motional converter with straight yoke.
Figure 1:
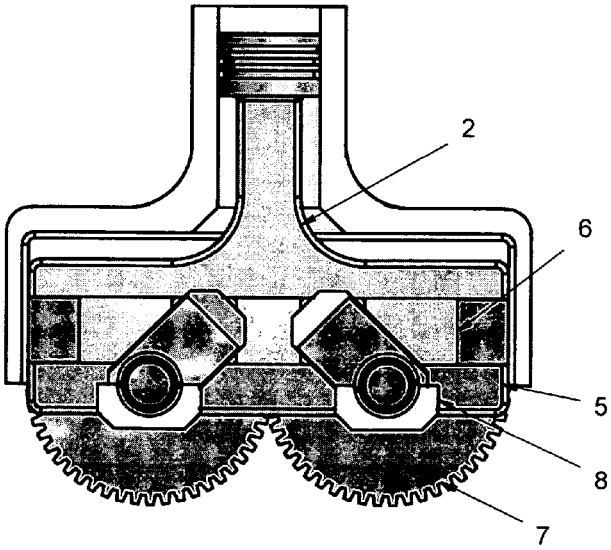
Figure 2:
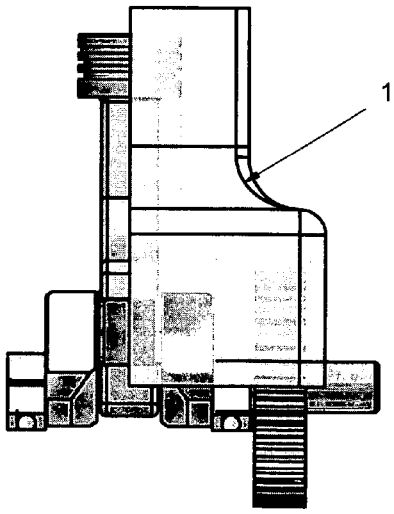

The cylinder block 1, FIG. 1, includes a bore for a piston, and the places for two crankshafts. The yoke is assembled of: piston, stem and top portion of yoke's slot as one part 2(or an assembly according to the manufacturer capability), two spacers 6 and clamp 5 make a path for the orbiting parts of the crankshafts 3 and bearings 4. Bearings have rectangular shape outside, round hole inside and cut on two equal parts. The root parts of the crankshafts and root bearings 9 are secured in the cylinder block by main bearing caps 8. Two gears 7 join both crankshafts making their motions dependent on each other.

The axes of the crankshafts are parallel. The line, which goes through the axes of the root parts of the crankshafts, is perpendicular to the axis of the cylinder and distances between cylinder axis and the crankshafts axes are equal. Preferable rotation of the crankshafts is from outside to inside in case of converting linear motion to rotational motion and from inside to outside if converting otherwise. The torque can be taken from or applied to any of two crankshafts or both of them if there is need for synchronize rotation of two shafts of some machines.

Figure 5:
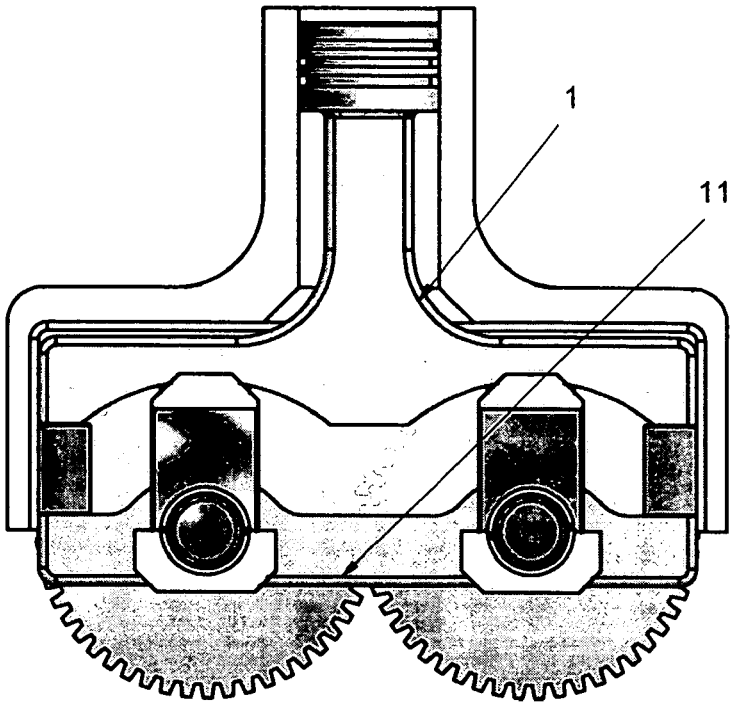
FIG. 5 is the front view of motional converter with shaped yoke.
Figure 6:
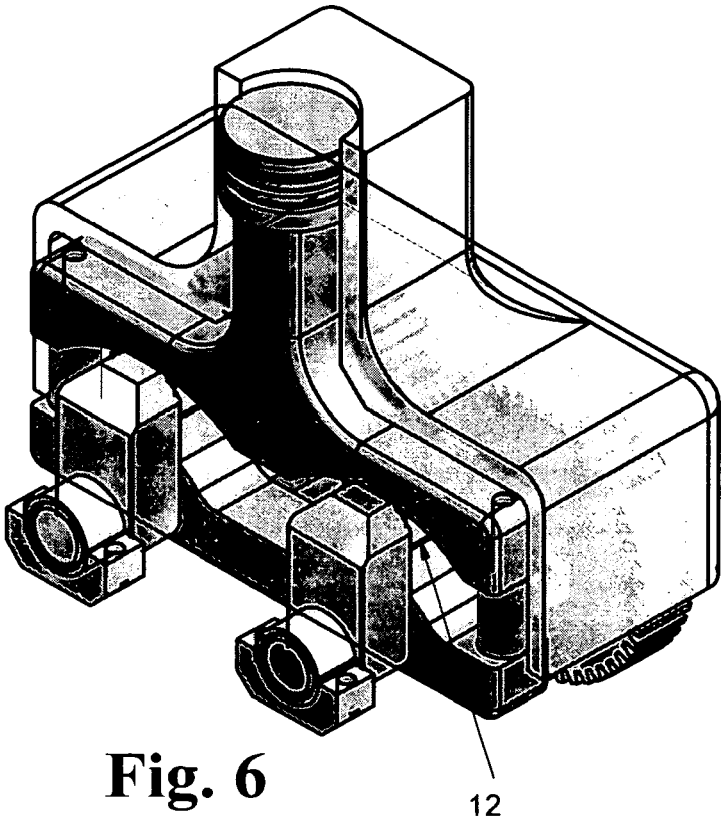
FIG. 6 is the isometric view of motional converter with shaped yoke.

Another type of yoke assembly, FIG. 5, includes a shaped yoke 10. The top portion of this yoke has two circular notches and the clamp 11 has two circular bumps. These features create two circular paths where bearings 12 with correspondent shape are moving.

This motion converter has the following advantages:

The force applied to piston affects the orbiting parts of crankshafts through the yoke and is always parallel to the cylinder axis. There is no force directing the piston against the cylinder wall, so there is no friction force acting against of the force applied to the piston. This significantly increases efficiency of this mechanism and lowers requirements for coefficient of friction of cylinder's material and the strength of the cylinder block structure.

The value of the stroke at each moment of downward movement of the piston in this motion converter is much smaller than at corresponding moment in existing mechanism (see diagram, FIG. 7, page 6), which means that chamber volume is smaller too. This promotes more efficient fuel combustion and creates greater force at any given moment of rotating crankshafts than it is in mechanisms of existing combustion engine.

Figure 7:
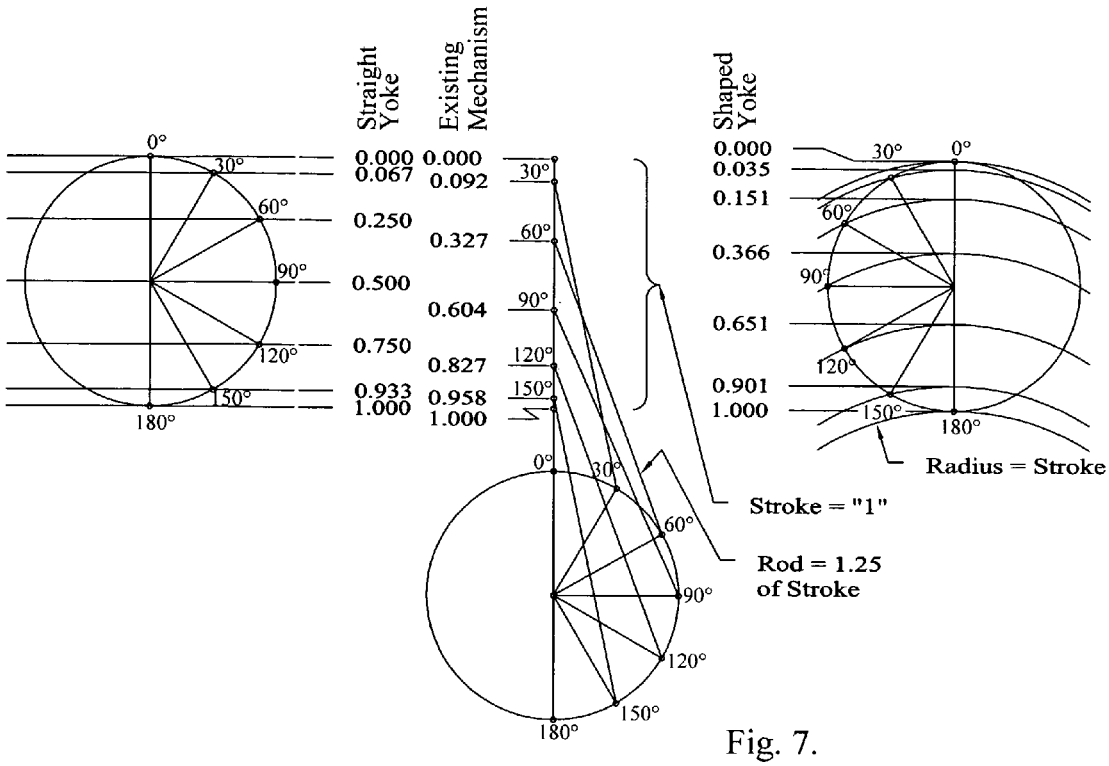
FIG. 7 is the diagram, where the differences in stroke value at every 30° of rotation of the crankshafts are shown; the trajectory of only one crankshaft is shown for positions of the straight and shaped yokes.

The diagram, FIG. 7, shows the difference in stroke at 30° increments between existing mechanism of combustion engine (in the middle) and motion converter with straight yoke on the left and shaped yoke on the right. The stroke in this diagram is equal "1 unit" for each mechanism; the length of the connecting rod in existing mechanism is 1.25 times of the length of the stroke. The radius of the shaped path of the shaped yoke in the motion converter is equal stroke. The stroke chart, page 6, shows numerical values of the stroke at each increment angle and ratio "k" between strokes in existing mechanism and motion converter. It is obvious that different length of the connecting rod in existing mechanism and different radius of the paths in the shaped yoke of the motion converter will change ratio but significant advantage for motion converter remains.

The following is simple calculation of the volume, pressure, force and torque in the motion converter with straight and shaped yoke according to the volume, pressure, force and torque in existing mechanism of combustion engine at each increment angle. In the following relationships:

$P_1$—pressure in the cylinder of existing combustion engine at increment angle;

$V_1$—volume of the cylinder of existing combustion engine at increment angle;

$T_1$—temperature in the cylinder of existing combustion engine at increment angle;

$P_2$—pressure in the cylinder of motion converter at increment angle;

$V_2$—volume of the cylinder of motion converter at increment angle;

$T_2$—temperature in the cylinder of motion converter at increment angle;

$F_1$—force affecting the piston in existing combustion engine at increment angle;

$F_2$—force affecting the piston in motion converter at increment angle;

k—ratio coefficient for volume, pressure, force and torque;

S—cylinder area (the same for all mechanisms).

Gas condition at any given time is: $P=T/V$ or $T=P\times V$. Amount of gas burned in the cylinder is equal at any increment angle in each mechanism. So, $T_1=T_2$ and gas condition is $P_1\times V_1=P_2\times V_2$. Dividing both sides of this equation on $V_1$ we will get: $P_1=P_2\times V_2/V_1$ and $V_2/V_1$ is the instantaneous ratio of cylinder volume of the motion converter to the cylinder volume of existing mechanism. $V_2/V_1=k$. Now, the equation for gas condition appears as: $P_1=P_2\times k$ or $k=P_1/P_2$(1).

The force effecting the piston is: $F_1=P_1\times S$ and $F_2=P_2\times S$. Area S is the same for any mechanism. So, $F_1/P_1=F_2/P_2$ or $F_2=F_1\times P_2/P_1$. With reference to equation (1) this equation becomes $F_2=F_1/k$ (2).

Figure 8:
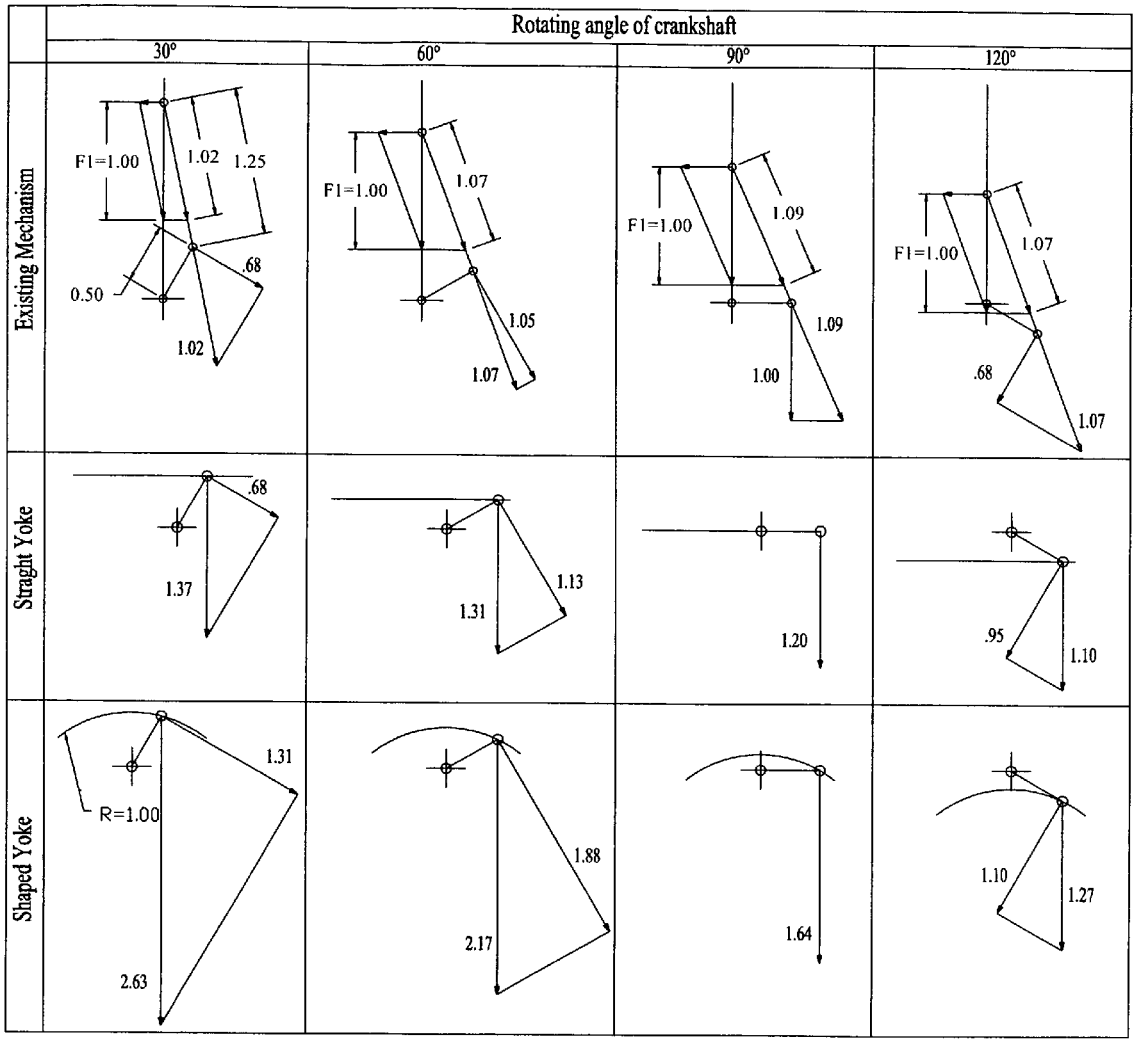
FIG. 8 is the diagram, where are shown the values of the forces in each type of mechanism at every 30° of rotation of crankshafts; the values of the forces applied to the piston are calculated according to the value of the combustion chamber of each mechanism at the correspondent moment and under condition that crankshafts in each mechanism rotate with the same rpm and the same amount of fuel is burned at any moment of cycle.

FIG. 8 is a diagram showing forces acting in mechanisms described above. The force $F_1$ effecting piston in existing mechanism is "1 unit" at each increment. The forces affecting the piston in motion converter calculated by equation (2) according to the value of "k" ratio coefficient at each increment. The force, which is always perpendicular to the crank arm, creates the torque. The values of all forces and torques shown on the chart below diagram 8. The chart shows increase of torque and force from 50% to roughly 90% in motion converter with shaped yoke. With purpose to keep same amount of power output in motion converter as in existing mechanism need less fuel supply. Motion converter has advantage over the mechanism used in Dwelling Scotch Yoke Engine. The reaction (resistant force) from the flywheel (see U.S. Pat. No. 5,331,926, part 20) acts off the cylinder axis and creates stress where yoke and stem are joined. A bushing is required to take care about this force, which otherwise would press piston to the cylinder wall. The reaction force in motion converter is split on two equal forces acting on both sides of the yoke's stem reducing stress on its root.

I claim as my invention:

1. A mechanism to convert reciprocating motion to rotational motion and rotational motion to reciprocating motion, said mechanism comprising:

a cylinder block including a cylinder bore;

a piston-yoke disposed for reciprocating motion relative to said cylinder block; said piston-yoke including a transverse yoke slot, and a piston extending perpendicularly from said slot into said cylinder bore;

opposing parallel crankshafts mounted on said block and operatively connected to said piston-yoke, said crankshafts each including a crankpin extending through said yoke slot for reciprocating motion therealong as said piston reciprocates in said bore and said crankpin revolves in an orbital path relative to its crankshaft;

said crankshafts each including a drive gear fixed thereto, said drive gears in mutual mating engagement for synchronous opposing rotation of said crankshafts.

2. A mechanism as defined in claim 1 wherein said yoke slot is a straight transverse slot along which said crankpins reciprocate, the reciprocating motion of said piston-yoke relative to the rotational motion of said crankshafts being simple harmonic.

3. A mechanism as defined in claim 2, said crankshafts further including a crankpin bearing around each of said crankpins, said bearings being non-rotatable and slidable within said yoke slot.

4. A mechanism as defined in claim 1 wherein said yoke slot includes a first arcuate portion concentric with one of said crankshafts and a second arcuate portion concentric with the other of said crankshafts, said crankpins each reciprocating along one of said arcuate portions of said slot, said arcuate slot portions affecting the characteristic of relative motions of said yoke and said crankshafts.

5. A mechanism as defined in claim 4, said crankshafts further Including a crankpin bearing around each of said crankpins, said bearings being non-rotatable and slidable within said yoke slot.

* * * * *